US005105858A

United States Patent [19]

Levinson

[11] Patent Number: 5,105,858

[45] Date of Patent: Apr. 21, 1992

[54] WATER DISPENSER BOTTLE

[76] Inventor: Lionel R. Levinson, 1570 Casale Rd., Pacific Palisades, Calif. 90272

[21] Appl. No.: 615,502

[22] Filed: Nov. 19, 1990

[51] Int. Cl.[5] ..... B65D 21/02; B65B 3/06

[52] U.S. Cl. ..... 141/2; 141/18; 141/35; 141/98; 141/364; 141/319; 222/143; 222/185; 220/23.83; 220/23.6; 206/509; 206/511; 62/390

[58] Field of Search ..... 141/35, 18, 21, 2, 100, 141/102, 105-107, 324-327, 363-366, 383, 386, 98, 319-322, 1; 222/143, 185; 220/23.6, 23.4, 23.83, 601; 206/503, 508, 509, 511; 215/2, 6, 10; 62/390, 391

[56] References Cited

U.S. PATENT DOCUMENTS

| | | | |
|---|---|---|---|
| 302,565 | 7/1884 | Hoyt | 215/2 X |
| 340,995 | 5/1886 | Forshaw | 220/23.6 |
| 588,499 | 8/1897 | Springfield | 215/2 X |
| 596,746 | 1/1898 | Fulcher | 215/2 X |
| 648,904 | 5/1900 | Hart | 141/363 |
| 912,281 | 2/1909 | Brunner et al. | 62/390 |
| 2,652,174 | 9/1953 | Shea et al. | 222/185 |
| 2,695,614 | 11/1954 | Lockhart | 215/6 X |
| 3,106,845 | 10/1963 | Dimmick | 141/35 X |
| 3,474,843 | 10/1969 | Maris | 215/10 X |
| 3,782,602 | 1/1974 | Page | 222/143 |
| 3,949,876 | 4/1976 | Bridges et al. | 220/23.6 X |
| 3,980,185 | 9/1976 | Cain | 206/509 |
| 4,313,477 | 2/1982 | Sebalos | 141/364 X |
| 4,398,653 | 8/1983 | Daloisio | 222/185 |
| 4,557,399 | 12/1985 | Redick, Jr. | 141/18 X |
| 4,805,808 | 2/1989 | Larson | 222/185 |
| 4,892,207 | 1/1990 | Cullis | 215/10 X |
| 4,921,112 | 5/1990 | Juhlin et al. | 215/6 X |
| 4,921,126 | 5/1990 | Wahtke et al. | 206/509 X |
| 4,944,400 | 7/1990 | Van Onstein et al. | 220/23.83 X |

FOREIGN PATENT DOCUMENTS

| | | | |
|---|---|---|---|
| 0254103 | 5/1963 | Australia | 141/364 |
| 0565248 | 3/1958 | Belgium | 220/23.6 |
| 0324699 | 7/1989 | European Pat. Off. | 220/23.83 |
| 2165676 | 5/1973 | Fed. Rep. of Germany | 206/511 |
| 2249552 | 6/1975 | France | 222/143 |
| 2547562 | 12/1984 | France | 220/23.83 |
| 0645342 | 9/1962 | Italy | 206/511 |
| 2219780 | 9/1990 | Japan | 220/23.83 |

*Primary Examiner*—Henry J. Recla
*Assistant Examiner*—Casey Jacyna
*Attorney, Agent, or Firm*—Cislo & Thomas

[57] ABSTRACT

A stackable, lightweight water dispenser bottle and method of using a plurality of such bottles in conjunction with a conventional water cooler is disclosed. The bottle comprises a generally parallelepipedal container body with rounded edges and corners with a plurality of dimples in a top portion and complementarily shaped protuberances on a bottom portion. The top portion has a central depression therein with a round hole surrounded by a cylindrical collar sealed by a screw-on cap. A neck portion rising from a central depression in the bottom portion terminates in an opening communicating with the interior of the container body and is sealed with a plastic cap after the water bottle is filled. A first such water bottle can be inverted and sealingly inserted into the opening at the top of a water cooler to partially fill the cooler. A second water bottle with its neck portion uncapped is sealingly inserted into the hole surrounded by the collar of the first water bottle to add the contents of the second water bottle to the water cooler. Each water bottle is sized to accommodate about 2.5 to 3.5 gallons and filled with water weighs approximately 21 pounds, thereby facilitating lifting, inverting, and positioning efforts in filling a water cooler. A stacking spacer arrangement allows convenient storage of filled bottles.

22 Claims, 4 Drawing Sheets

WATER DISPENSER BOTTLE

BACKGROUND OF THE INVENTION

Along with an increased concern about the purity and potability of municipally provided water supplies has come an increased use of bottled water services provided commercially. The commercially provided water is said to be purer and better tasting than what comes out of the tap in many localities.

Generally, the commercial water purveyors supply the subscriber with some type of dispensing apparatus such as the familiar water cooler that can now be found in countless offices and homes. Bottled water is usually provided in large plastic bottle-type containers that hold about five gallons and weigh roughly 42 pounds.

Even for a strong, healthy adult, the act of lifting a bulky and heavy water bottle from floor level and inverting it at a height of about four feet above the floor into position on top of a water cooler presents certain problems. Careless or improper lifting techniques may produce hernias or back injuries or exacerbate already existing ones. Spilling water in the process of inverting and positioning the water bottle is also commonplace because of the size and weight of the conventional water bottle.

For a child or a weak adult the task of refilling a water cooler may present a well nigh insurmountable problem. It would be a great boon to that segment of the bottled water consuming public consisting of the young, the elderly, or the less robust if there existed a stackable water dispenser bottle that was lighter in weight and easier to handle than the water bottles conventionally employed. Previous attempts to solve the above-mentioned problems have not yielded a completely satisfactory solution.

U.S. Pat. No. 4,892,207 to Cullis discloses a bottled water container of the type in which the container is supported upon the water cooler for selective removal and replacement, the container having a handle straddling a recess located in the body of the container at the intersection of the side and upper end walls thereof and bridging a gap created by the recess in the peripheral edge along the intersection of the side and upper end walls of the container. The purpose of the handle is to facilitate lifting, upending, and placement of the container in proper position in the water cooler. The handle is hollow and molded separate from the body of the container and is integrated with the body such that the interior of the handle is isolated from the interior of the container body so that the interior of the container can be readily cleaned to enable reuse of the bottled water container. The container disclosed, however, has a conventional size and weight.

U.S. Pat. No. 4,308,955 to Schieser et al. is directed to a large lightweight plastic bottle of rectangular or square transverse cross section with spaced reinforcing ribs or bands extending therearound. Opposed flat faces or sides of each bottle are provided with a square locking projection and a complementary receiving socket, respectively, so that a plurality of such bottles can be stacked on their sides with the projections and sockets of adjacent sides interfitted to keep the bottles in alignment in the stack and with the reinforcing ribs superimposed for strength. The water bottle disclosed, however, has a conventional shape and size.

The patents listed directed below may have some relevance to the invention disclosed in the specification, claims, and drawing which follow.

| Patent Number | Name of Inventor | Date Issued |
|---|---|---|
| 282,974 | G. S. Fairchild | Aug. 14, 1883 |
| 302,565 | L. S. Hoyt | July 29, 1884 |
| 571,430 | S. Costello | Nov. 17, 1896 |
| 587,895 | C. B. White | Aug. 10, 1897 |
| 591,280 | E. Junker | Oct. 5, 1897 |
| 596,746 | W. H. Fulcher | Jan. 4, 1898 |
| 598,782 | F. Hill | Feb. 8, 1898 |
| 3,323,668 | D. G. Hills | June 6, 1967 |
| 3,391,824 | A. P. J. Wiseman | July 9, 1968 |
| 3,631,974 | R. B. Schaefer et al. | Jan. 4, 1972 |
| 4,513,865 | E. R. Melzi | Apr. 30, 1985 |

None of the prior-art references described or mentioned above discloses the stackable, lightweight water dispenser bottle of the present invention, which provides various improvements and advantages over the prior art.

SUMMARY OF THE INVENTION

A stackable, lightweight water dispenser bottle and method of using a plurality of such bottles in conjunction with a conventional water cooler is disclosed. The bottle comprises a generally parallelepipedal container body with rounded edges and corners. A top portion of the container body has a central depression therein with a round hole surrounded by a cylindrical collar, preferably having external threads and meant to be sealed by a screw-on cap.

The top portion further has a plurality of concave dimples located on the outer surface thereof. A bottom portion of the container body has a central depression from which rises a neck portion terminating in an opening communicating with the interior of the container body, and meant to be sealed with a plastic cap after the water bottle is filled, the cap having a tab for ease in removal of the cap when the contents of the bottle are used to fill a water cooler.

The bottom portion further has a plurality of protuberances located at positions opposite the dimples on the top portion and having a convex shape and size which complement the shape and size of one of the dimples on the outer surface of the top proportion. After removal of the cap on the neck portion, a first such water bottle can be inverted and sealingly inserted into the opening at the top of a water cooler to partially fill the cooler with water. The screw cap on the top portion of the water bottle thus mounted on the water cooler is then removed, and a second water dispenser bottle with its neck portion uncapped is sealingly inserted into the hole surrounded by the collar of the first water bottle to add the contents of the second water bottle to the water cooler reservoir.

Each water dispenser bottle is preferably made of a lightweight plastic material such as a polycarbonate and has a size to accommodate about 2.5 to 3.5 gallons of water. Since an individual water dispenser bottle filled with water weighs approximately 21 pounds, lifting, inverting, and positioning efforts in filling a water cooler are facilitated by the present invention.

The invention additionally comprises a rectangular spacer element having a central hole sized to accept the neck portion of a dispenser bottle and having planar top and bottom surfaces. Four protuberances identical to those found on a water dispenser bottle are located on the top surface of the spacer at positions corresponding to those of the dimples on the surface of the bottom portion of a water dispenser bottle. Four dimples identical to those found on the surface of the top portion of a water dispenser bottle are located at corresponding positions of the bottom surface of the spacer element.

The spacer is preferably made from a lightweight, stiff plastic material such as styrofoam. The thickness of the spacer element is such that when the dimples on the bottom surface are interfitted with the protuberances on the top portion of a water dispenser bottle, the dimples on the bottom of a second water dispenser bottle can be engaged by the protuberances on the top surface of the spacer element with sufficient clearance between the top of the capped neck portion of the first water dispenser bottle and the screw-cap in the central depression on the bottom of the second water dispenser bottle.

A plurality of water dispenser bottles can be stacked in a vertical column with the screw-cap bearing end of the first water dispenser bottle resting on the floor and successive water dispenser bottles stacked on top of the first water dispenser bottle with spacer elements between adjacent bottles and interfitted therewith.

Accordingly, it is an object of the present invention to provide a water dispenser bottle which is about half the size and weight of a conventional bottled water container.

It is another object of the invention to provide a water dispenser container made of a lightweight plastic and having a generally parallelepipedal shape.

Another object of the invention is to provide a water dispenser bottle designed so that a plurality of such bottles can be stacked in a stable, nonswaying column.

Still another object of the invention is to provide a water dispenser bottle having rounded corners and edges for a pleasing appearance and to facilitate cleaning of the interior of the bottle.

Yet another object of the present invention is to provide a water dispenser bottle having a plurality of dimples on the top surface thereof and a plurality of protuberances complementary in shape to the dimples on a bottom surface of the bottle opposite the position of the dimples.

Still another object of the invention is to provide a water dispenser bottle that is stackable by virtue of interfitting dimples and protuberances when the top of a first such bottle is placed in contact with the bottom of a second such bottle, thus bringing the edges into alignment for esthetic reasons.

Another object of the present invention is to provide a water dispenser bottle having a top opening which can be sealed by a screw cap arrangement and a cap-sealed neck portion on a bottom part of the bottle which can be sealingly inserted into the uncapped opening in the top of a second such bottle to allow the contents of the first bottle to flow into the second bottle and into a water cooler on which the second bottle is mounted.

Yet another object of the invention is to provide a method of filling a conventional water cooler using the smaller, lighter water dispenser bottles of the present invention in a stacking arrangement to combine their contents in the reservoir of a water cooler.

One more object of the invention is to provide a spacer element for placement between adjacent water dispenser bottles when stacking them in a vertical column, the spacer element having protuberances and dimples on its top and bottom surfaces, respectively, to allow engagement of adjacent water dispenser bottles with a spacer between them to stabilize their positions and prevent any relative lateral movement between the bottles.

Finally, it is a purpose of the present invention to provide a stackable, lightweight water dispenser bottle and a method of using it to greatly reduce the effort involved in filling a conventional water cooler, to facilitate this operation for the young, elderly, or weak, and to prevent physical injuries associated with lifting large, heavy objects such as the conventional 5-gallon water bottle.

These and other objects and features of the present invention will be apparent from the following detailed description taken with reference to the figures of the accompanying drawing, wherein like elements are denoted by like reference numerals.

DETAILED DESCRIPTION OF THE INVENTION

Figure 1:
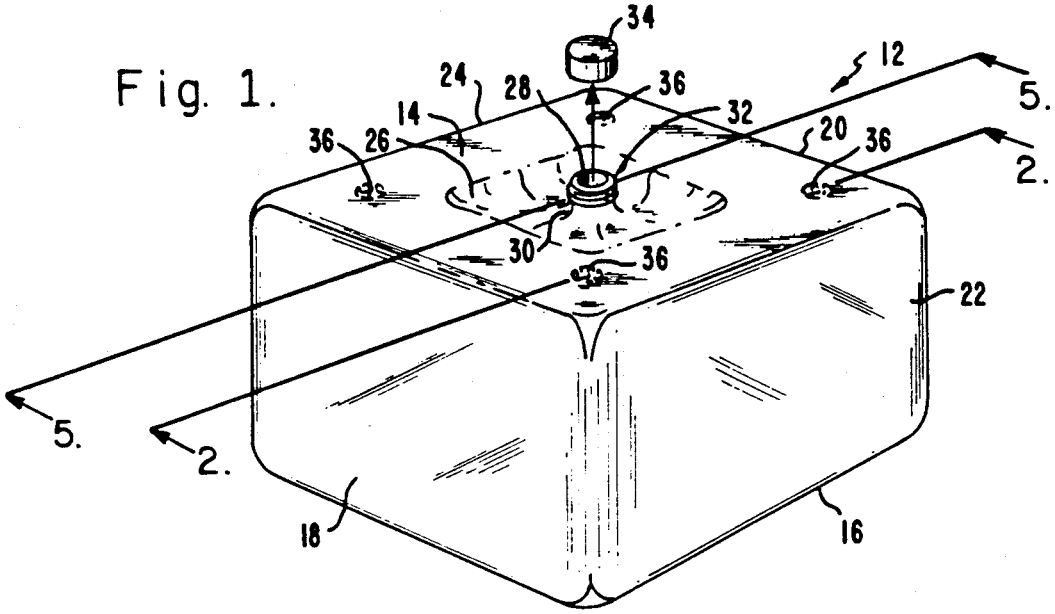
FIG. 1 is a top perspective view of the stackable compact water dispenser container of the present invention.

As shown in FIG. 1, a stackable, lightweight water bottle 10 for use in combination with a water cooler comprises a parallelepipedal container body 12 having generally parallel top and bottom portions 14 and 16, respectively, with a first set of opposed side walls 18 and 20 and a second set of opposed side walls 22 and 24 contiguous with and connecting said top and bottom portions to define an interior volume 25. Container body 12 has rounded edges and corners as shown in FIG. 1, to facilitate cleaning of the interior of container body 20 and to provide a pleasing appearance.

Figure 2:
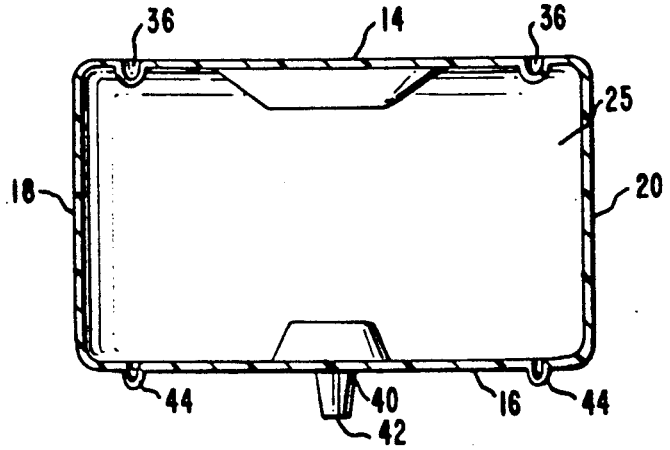
FIG. 2 is a sectional view of the water dispenser container of the invention as indicated in FIG. 1.

Top portion 14 has a central depression 26 which has a circular hole 28 communicating with the interior volume 25 of container body 12. Circular hole 28 is surrounded by a cylindrical collar 30 having an exterior threaded portion 32 to accommodate a screw cap 34. Four dimples 36 are located symmetrically with respect to a vertical axis through the center of container 12 in the outer surface of top portion 14. As shown in the sectional view of FIG. 2, each dimple 36 has a substantially hemispherical concave shape.

Figure 3:
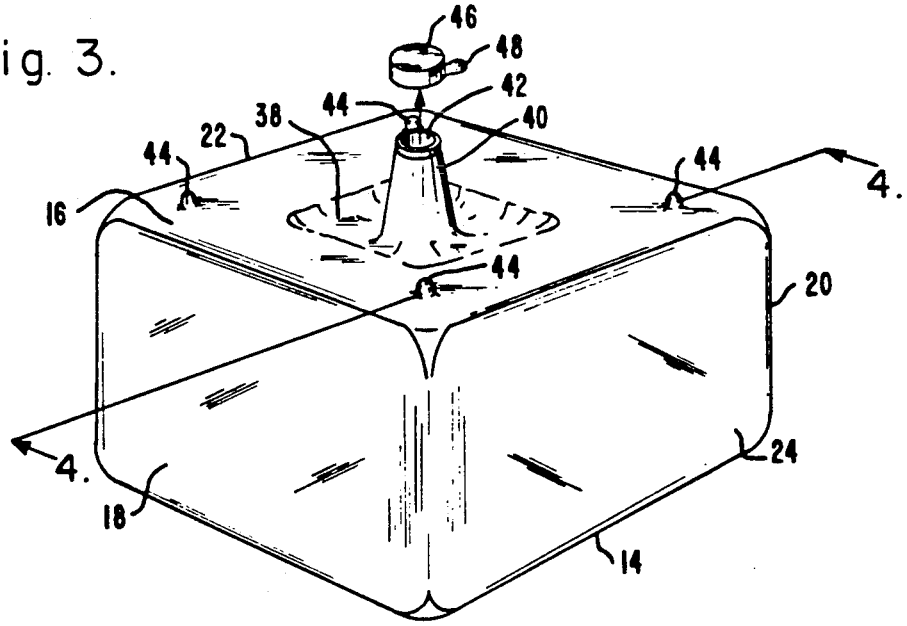
FIG. 3 is a bottom perspective view of the stackable compact water dispenser container of the invention.
Figure 4:
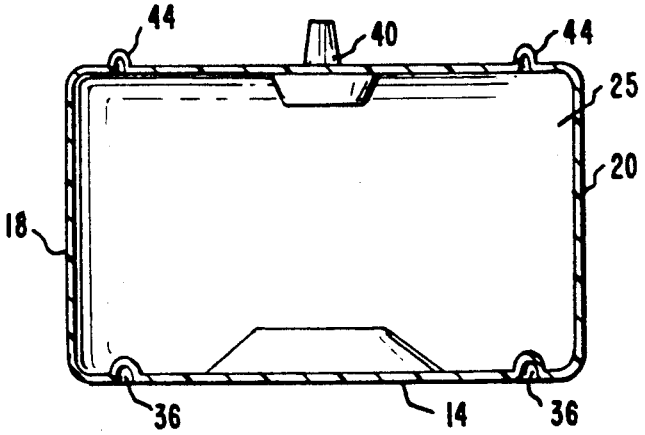
FIG. 4 is a sectional view of the water dispenser container of the invention as indicated in FIG. 3.
Figure 5:
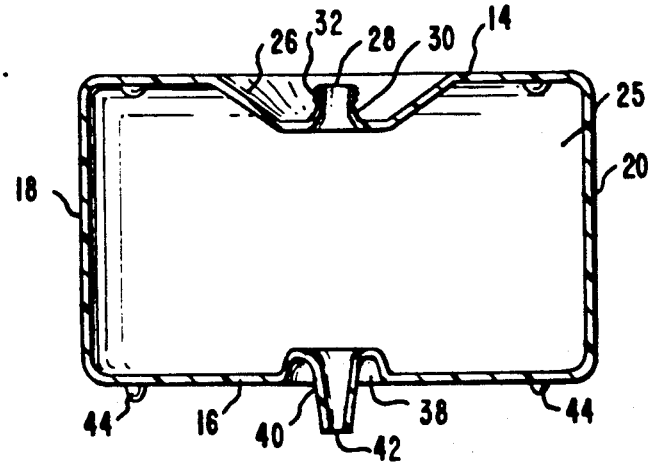
FIG. 5 is a sectional view of the water dispenser bottle of the invention as indicated in FIG. 3.

As shown in FIG. 3, bottom portion 16 has a central depression 38 from the lowest part of which rises a frustoconical neck portion 40 terminating in an opening 42 which communicates with the interior volume 25 of container body 12. Four protuberances 44 are located on the exterior surface of bottom portion 16 at positions opposite those of the four dimples 36. Each protuberance 44 has a convex hemispherical shape which matches the concave shape of a dimple 36. The sectional views of FIGS. 4 and 5 show further details of the protuberances 44 and the neck portion 40.

Water bottle 10 is preferably made of a lightweight plastic material such as polyethylene or the polycarbonate plastics conventionally used for water cooler bottles.

After the interior volume 25 of container body 20 has been filled with water, opening 42 at the end of neck portion 40 is meant to be sealed, such as with a conventional plastic cap 46 with a tab 48 for easy removal.

Figure 6:
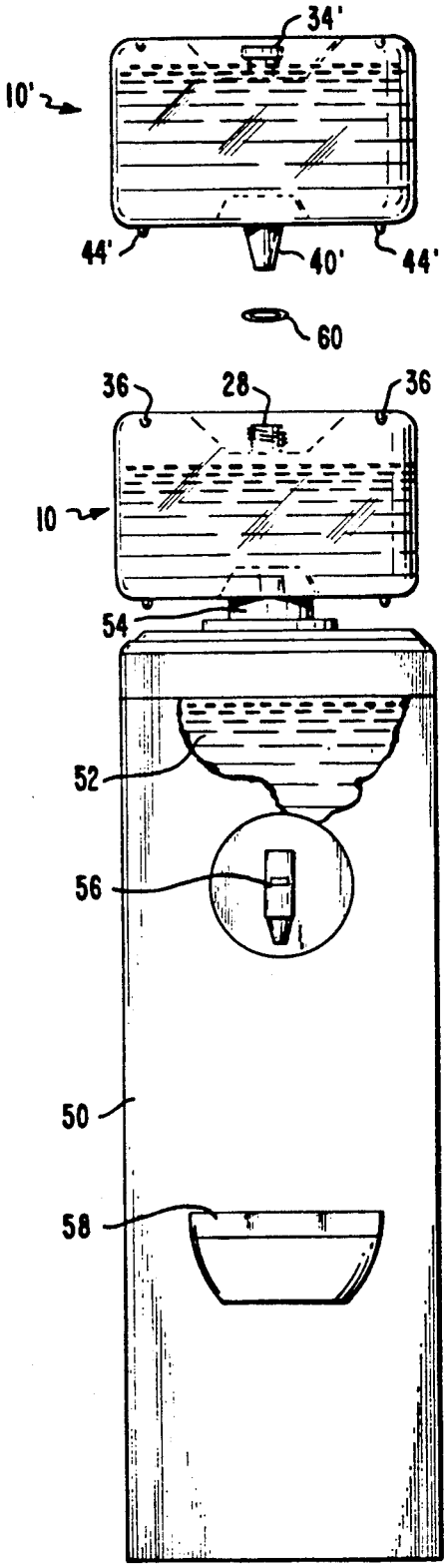
FIG. 6 is a front elevational view, partly broken away and partly in section, of a first water dispenser bottle installed atop a conventional water cooler with a second such water dispenser bottle above it just before insertion.

Referring to FIG. 6, a conventional water cooler 50 has a reservoir for water 52 which is filled via an orifice 54 at the top. Cooler 50 further comprises a spigot arrangement 56 to allow water from reservoir 52 to flow out into a cup or glass placed on horizontal shelf 58.

A first water dispenser container 10 is shown mounted atop water cooler 50 with neck portion 40 inserted into orifice 54 after cap 46 has been removed. Also shown is a second water dispenser container 10' about to be stacked on top of container 10 with its neck portion 40' to be inserted in hole 28 and with protuberances 44' about to be fitted into dimples 36.

A watertight seal between first water dispenser container 10 and second water dispenser container 10' is effected through a tight frictional fit between frustoconical neck portion 40' and cylindrical collar 30 or through a compressible annular flange 60 positioned therebetween. The degree of taper of frustoconical neck portion 40 is preferably between 5 and 25 degrees. Screw cap 34 has been removed from first water dispenser container 10 but screw cap 34' is left on water dispenser container 10'.

Figure 7:
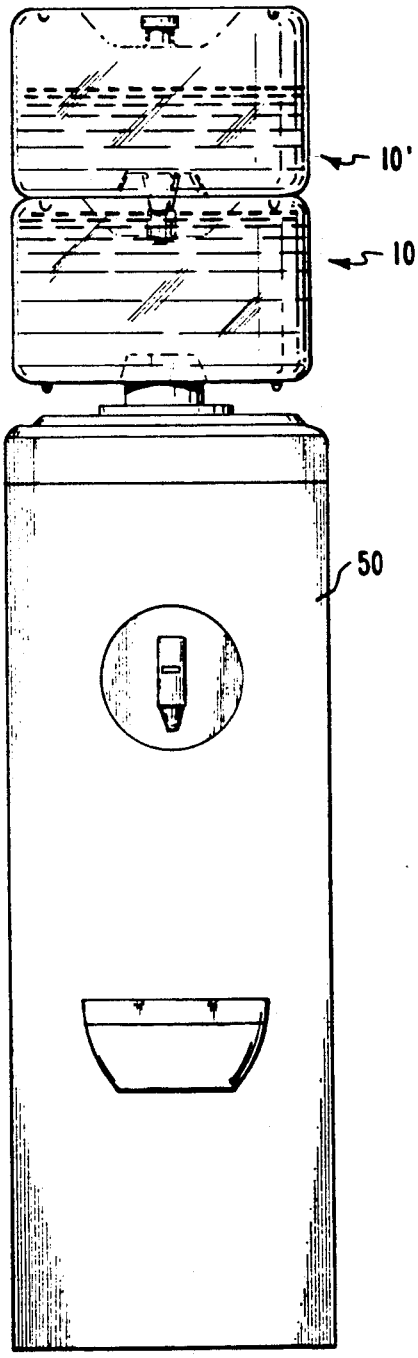
FIG. 7 is a front elevational view of a conventional water cooler with first and second stacked water dispenser bottles stacked atop the cooler.

Referring to FIG. 7, water dispenser containers 10 and 10' are shown stacked atop water cooler 50 after the process of filling reservoir 52 has been completed. Protuberances 44' of water dispenser container 10' are fully engaged by recesses 36 in water dispenser container 10 so that there is no tendency for container 10' to rotate with respect to container 10 and the two containers are locked together in a stable position. A third water dispenser container could be added to the arrangement, but unless water cooler 50 had a lot of weight in its lower part, this could result in a dangerously topheavy arrangement.

Since water dispenser containers 10 and 10' each weigh only about 21 pounds when filled with water, the lifting and manipulating efforts required to fill water cooler 50 are substantially reduced in comparison to using conventional 5-gallon water bottles. The present invention thus serves a valuable purpose in making it possible for individuals who lack the requisite strength for lifting and handling 5-gallon water bottles to fill a conventional water cooler with the stackable, compact water dispenser container 10 provided by the present invention.

Figure 8:
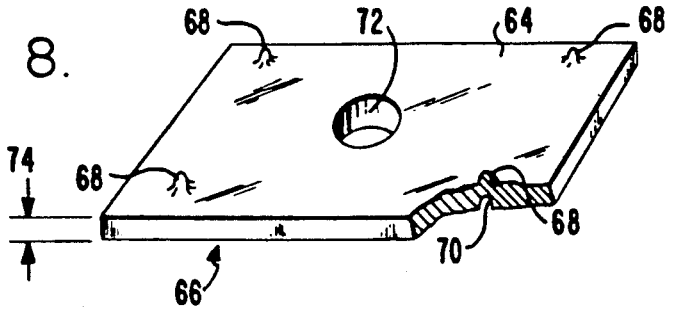
FIG. 8 is a perspective view, partly broken away, of a spacer element in accordance with the invention.

Referring to FIG. 8, a spacer element 62 is provided by the invention to facilitate stacking of filled water dispenser bottles. Spacer element 62 comprises a generally rectangular sheet of a stiff, lightweight material having parallel and generally planar top and bottom surfaces 64 and 66, respectively. Four protuberances 68 on top surface 64 of spacer element 62 are located so as to fit into the dimples on the screw-cap bearing end of a water dispenser bottle 10. Four dimples 70 are located opposite protuberances 68 on bottom surface 66 of spacer element 62. A central hole 72 in spacer element 62 is designed to accommodate the neck portion 40 of a water dispenser bottle 10 when dimples 70 of spacer element 62 are interfitted with the protuberances 36 on the top portion 14 of a water dispenser bottle 10.

Figure 9:
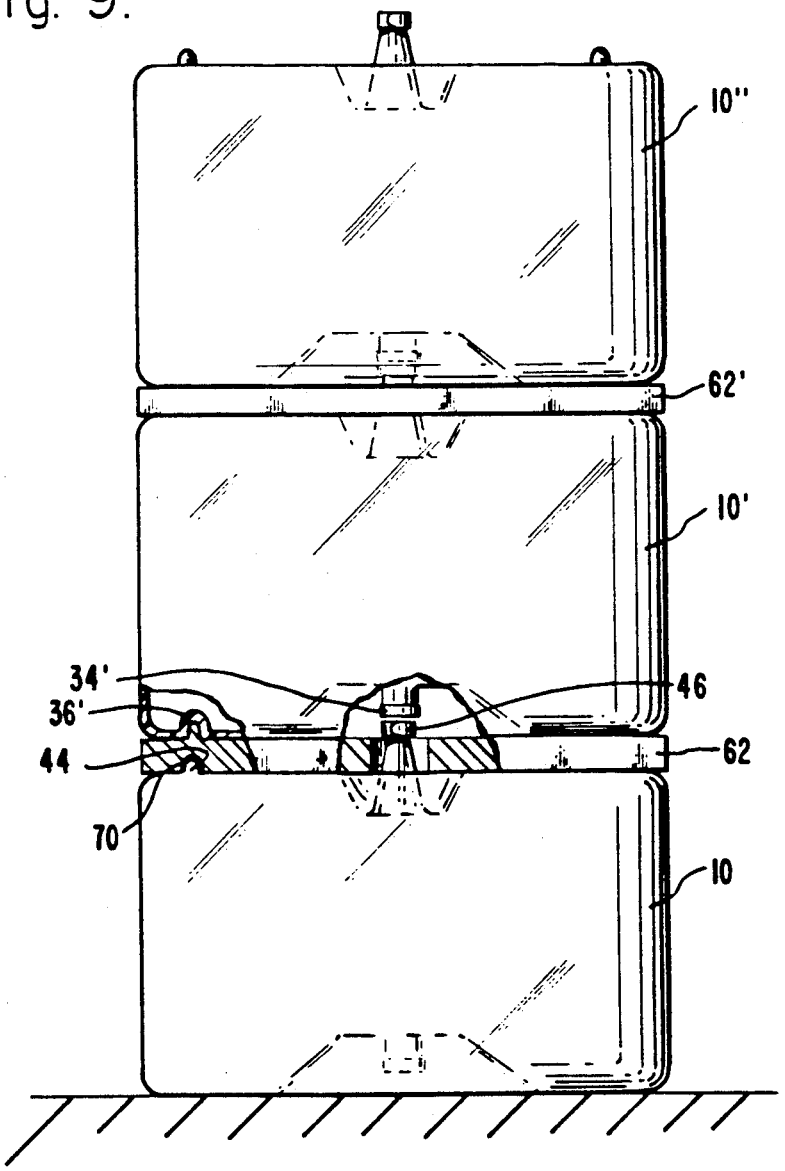
FIG. 9 is a side elevational view, partly broken away, of three water dispenser bottles of the invention stacked in a vertical column using spacer elements of the type shown in FIG. 7 to stabilize the relative positions of adjacent bottles.

The minimum value of thickness 74 of spacer element 62 is dictated by the requirement that a second water dispenser bottle 10' is stacked on top of a first water dispenser bottle 10 with a spacer element 62 between them, the topmost portion of cap 46 on water dispenser bottle 10 must not interfere with the lowest portion of screw-on cap 34' of water dispenser bottle 10', as can be seen from FIG. 9.

FIG. 9 shows a water dispenser bottle 10'' stacked on top of a water dispenser bottle 10' which in turn is stacked on top of a water dispenser bottle 10, with spacer element 62 sandwiched between bottles 10 and 10' and spacer element 62' sandwiched between bottles 10'' and 10'. In the broken away portion of FIG. 9, protuberance 44 of water dispenser bottle 10 can be seen inserted into dimple 70 of spacer element 62 and protuberance 68 of spacer element 62 can be seen inserted into dimple 36' of water dispenser bottle 10'. Spacer elements 62 and 62' prevent changes in the relative lateral positions of water dispenser bottles 10, 10', and 10''.

The exact shape of spacer element 62 is not crucial except for the requirement that it be large enough in area to include the plurality of protuberances 68 and dimples 66 in their properly located positions. Thus, for example, the four corners of the spacer element 62 shown in FIG. 8 could be truncated to save material without seriously affecting the performance of the spacer element.

The water dispenser bottle 10 of the present invention is conveniently stackable for ease in shipping and storage. A plurality of bottles 10 can be stacked in a column one above the other with spacer elements 62 between adjacent bottles to provide a strong, stable storage arrangement.

It should be understood that the invention in its broader aspects is not limited to the specific embodiments shown and described herein, but departures may be made therefrom within the scope of the appended claims without departing from the principles of the invention and without sacrificing its chief advantages. For example, there are other well-known alternatives to the threaded collar 30 and screw cap 34 arrangement described hereinabove. For example, some sort of lip could be provided at the distal end of collar 30 and a snap-on type of cap could be provided to effect sealing closure of round hole 28 in container body 12. Similarly, there are various ways of sealing opening 42 at the end of neck portion 40. All such similar modifications and changes will make themselves apparent to those of ordinary skill in the art, and all such changes and modifications are intended to be covered by the appended claims.

I claim:

1. A stackable water bottle for use in combination with a water cooler having an orifice on top thereof, comprising:

a generally parallelepipedal container body having generally parallel top and bottom portions and two sets of opposed sidewalls contiguous with and connecting said top and bottom portions to define an interior volume, said container body having rounded edges and corners;

said top portion having a central depression therein with a round hole surrounded by a cylindrical collar means for receiving a cap means for sealing said round hole, said top portion further having a plurality of concave dimples located on an outer surface of said top portion;

said bottom portion having a central depression from which rises a neck portion terminating in an opening communicating with said interior volume, said bottom portion further having a plurality of protuberances on an outer surface thereof at positions opposite said dimples on said top portion, each said protuberance having a convex shape and size which complement a concave shape and size of one of said dimples on said outer surface of said top portion;

wherein a first said water bottle filled with water can be placed atop said water cooler with said neck portion inserted into said orifice and whereby a second said water bottle filled with water can be stacked atop said first water bottle, wherein each said protuberance can be fitted into a correspondingly located one of said dimples and said neck portion of said second bottle can be sealingly inserted into said round hole of said first bottle, said round hole in said second water bottle can be sealed by a said cap means.

2. The stackable water bottle of claim 1 wherein said plurality of dimples comprises four such dimples symmetrically located with respect to a vertical axis of symmetry passing through the center of said container body.

3. The stackable water bottle of claim 2 wherein said neck portion further comprises a closure means for sealing said opening after said hole in said top portion is sealed with a cap means and after said water bottle is filled with water.

4. The stackable water bottle of claim 3 wherein said opening is circular and said closure means comprises a plastic cap with a tab to facilitate removal of said cap.

5. The stackable water bottle of claim 1 wherein said collar means is externally threaded and said cap means comprises a screw cap.

6. The stackable water bottle of claim 1 wherein said interior volume is large enough to accommodate approximately 2.5 to 3.5 gallons of water.

7. The stackable water bottle of claim 1 wherein said container body comprises a lightweight plastic material.

8. The stackable water bottle of claim 1 wherein said neck portion has a frustoconical shape and is long enough so that when a first said water bottle is stacked on top of a second said water bottle with said protuberances matingly inserted into said dimples, said neck portion of said first water bottle is sealingly inserted and frictionally engaged in said hole in said top portion of said second water bottle.

9. The stackable water bottle of claim 1 further comprising an annular gasket means around said neck portion for watertight sealing of said neck portion to an inlet orifice of said water cooler or to said round hole of another said stackable water bottle.

10. The stackable water bottle of claim 1 further comprising spacer means for separating two said water bottles when one is stacked on top of another and for holding said two water bottles in a stable position with respect to relative lateral motion between said two bottles, said spacer means disposed between said top surface of said first water bottle and said bottom surface of said second water bottle.

11. The stackable water bottle of claim 10 wherein said spacer means comprises a thick sheet having generally planar top and bottom major surfaces, said top surface having a plurality of protuberances and said bottom surface having a plurality of dimples, and having a central hole larger in diameter than a largest cross-sectional area of said neck portion, wherein when said neck portion is inserted through said hole in said spacer means, said protuberances on said water bottle can be inserted into said dimples on said spacer means.

12. The stackable water bottle of claim 11 wherein said spacer means comprises a stiff, lightweight plastic material.

13. A stackable water bottle for use in combination with a water cooler having an inlet orifice in a top thereof, comprising:

a parallelepipedally shaped container body having generally parallel top and bottom portions with two intervening sets of opposed sidewalls and having rounded edges and corners;

said top portion having a central recessed part in an outer surface thereof with a round hole therein surrounded by an externally threaded cylindrical collar, said top portion further having four symmetrically located hemispherical dimples on an outer surface thereof;

said bottom portion having a central recessed part in an outer surface thereof from which rises a frustoconical neck terminating in a circular mouth communicating with an interior volume of said container, said neck having a length sufficient to extend substantially beyond a plane in which a major portion of said exterior surface of said bottom portion lies, said bottom portion further having four symmetrically located hemispherical nipples on said outer surface thereof opposite said dimples on said top portion, each said nipple having an exterior convex shape and size which are complementary to a concave shape and size of one of said dimples;

wherein a first said water bottle filled with water can be placed atop said water cooler with said neck inserted into said inlet orifice of said water cooler and whereby a second water bottle filled with water can be stacked atop said first water bottle, wherein each said nipple can be fitted into a correspondingly located one of said dimples, and said neck portion of said second bottle can be sealingly inserted into said round hole of said first water bottle.

14. The stackable water bottle of claim 13 wherein said container body comprises a lightweight plastic material.

15. The stackable water bottle of claim 14 wherein said interior volume of said container body is sufficiently large to hold approximately 2.5 to 3.5 gallons of water.

16. The stackable water bottle of claim 13 further comprising an annular gasket means around said neck portion for watertight sealing of said neck portion to said inlet orifice of said water cooler or to said round hole of another said stackable water bottle.

17. The stackable water bottle of claim 13 further comprising spacer means for separating two said water bottles when one is stacked on top of another and for holding said two water bottles in a stable position with respect to relative lateral motion between said two bottles, said spacer means disposed between said top surface of said first water bottle and said bottom surface of said second water bottle.

18. The stackable water bottle of claim 17 wherein said spacer means comprises a thick sheet having generally planar top and bottom major surfaces, said top surface having a plurality of protuberances and said bottom surface having a plurality of dimples, and having a central hole larger in diameter than a largest cross-sectional area of said neck portion, wherein when said neck portion is inserted through said hole in said spacer means, said protuberances on said water bottle can be inserted into said dimples on said spacer means.

19. The stackable water bottle of claim 18 wherein said spacer means comprises a stiff, lightweight plastic material.

20. A method of facilitating the filling of a water cooler having an inlet orifice in a top part thereof, comprising:

(a) supplying first and second stackable water bottles, each having a removable cap sealing an inlet opening and a removable seal on an outlet neck terminating in an open mouth;

(b) unsealing said outlet neck of said first water bottle and sealingly inserting said neck into said inlet orifice of said water cooler;

(c) removing said cap from said first water bottle resting on top of said water cooler;

(d) unsealing said outlet neck of said second water bottle; and (e) sealingly inserting said neck of said second water bottle into said inlet orifice of said first water bottle resting on said water cooler; wherein each said stackable water bottle is of a size and volume to contain about 2.5 to 3.5 gallons of water, so that the lifting and manipulating efforts required in filling said water cooler are substantially reduced compared to conventional methods.

21. The method of claim 20 wherein each said stackable water bottle comprises:

a generally parallelepipedal container body having generally parallel top and bottom portions and two sets of opposed sidewalls contiguous with and connecting said top and bottom portions to define an interior volume, said container body having rounded edges and corners;

said top portion having a central depression therein with a round hole surrounded by a cylindrical collar means for receiving a cap means for sealing said round hole, said top portion further having a plurality of concave dimples located on an outer surface of said top portion;

said bottom portion having a central depression from which rises a neck portion terminating in an opening communicating with said interior volume, said bottom portion further having a plurality of protuberances on an outer surface thereof at positions opposite said dimples on said top portion, each said protuberance having a convex shape and size which complement a concave shape and size of one of said dimples on said outer surface of said top portion;

wherein a first said water bottle filled with water can be placed atop said water cooler with said neck portion inserted into said orifice and a second said water bottle filled with water can be stacked atop said first water bottle, with each said protuberance fitted into a correspondingly located one of said dimples, and with said neck portion of said second bottle sealingly inserted into said round hole of said first bottle, said round hole in said second water bottle being sealed by a said cap means.

22. The method of claim 20 wherein each said stackable water bottle comprises:

a parallelepipedally shaped container body having generally parallel top and bottom portions with two intervening sets of opposed sidewalls and having rounded edges and corners;

said top portion having a central recessed part in an outer surface thereof with a round hole therein surrounded by an externally threaded cylindrical collar, said top portion further having four symmetrically located hemispherical dimples on an outer surface thereof;

said bottom portion having a central recessed part in an outer surface thereof from which rises a frusto-conical neck terminating in a circular mouth communicating with an interior volume of said container, said neck having a length sufficient to extend substantially beyond a plane in which a major areal portion of said exterior surface of said bottom portion lies, said bottom portion further having four symmetrically located hemispherical nipples on said outer surface thereof opposite said dimples on said top portion, each said nipple having an exterior convex shape and size which are complementary to a concave shape and size of one of said dimples;

wherein a first said water bottle filled with water can be placed atop said water cooler with said neck inserted into said inlet orifice of said water cooler and a second water bottle filled with water can be stacked atop said first water bottle, with each said nipple fitted into a correspondingly located one of said dimples, and with said neck portion of said second bottle sealingly inserted into said round hole of said first water bottle.

* * * * *